United States Patent [19]

Kleinloh et al.

[11] Patent Number: 4,475,985

[45] Date of Patent: Oct. 9, 1984

[54] PROCESS FOR THE PRODUCTION OF A DIAPHRAGM FOR ELECTROLYTIC CELLS

[75] Inventors: Werner Kleinloh, Haltern; Werner Thronberens, Marl, both of Fed. Rep. of Germany

[73] Assignee: Chemische Werke Huls Aktiengesellschaft, Marl, Fed. Rep. of Germany

[21] Appl. No.: 435,551

[22] Filed: Oct. 21, 1982

[30] Foreign Application Priority Data

Nov. 7, 1981 [DE] Fed. Rep. of Germany ..... 3144372

[51] Int. Cl.[3] ..... B29J 5/00

[52] U.S. Cl. ..... 162/219; 162/228; 162/229; 204/295

[58] Field of Search ..... 162/228, 229, 387, 393, 162/411, 106, 219

[56] References Cited

U.S. PATENT DOCUMENTS

| | | | |
|---|---|---|---|
| 1,819,300 | 8/1931 | Newcombe | 162/228 X |
| 1,855,497 | 4/1932 | Stuart | 204/295 X |
| 2,384,958 | 9/1945 | Pare | 162/229 |

FOREIGN PATENT DOCUMENTS

| | | | |
|---|---|---|---|
| 848579 | 9/1960 | United Kingdom | 162/229 |

*Primary Examiner*—John F. Niebling

*Attorney, Agent, or Firm*—Antonelli, Terry & Wands

[57] ABSTRACT

The process relates to the formation of diaphragms, for example those used for alkali chloride electrolysis in an aqueous solution. The formation of a layer-type diaphragm, accreted on a hollow diaphragm support from a slurry having a high solids content of diaphragm material, is made uniform.

During the accretion step, the diaphragm support is periodically lifted and lowered in the slurry (frequency 0.1–10 $min^{-1}$; amplitude 10–100 cm; velocity 2–20 cm/sec); its topside, at the upper reversal point of the oscillating motion, has a certain spacing (10–25 cm) from the constantly measured height of the level of slurry in the accretion tank and its underside cannot reach below a minimum distance (30 cm) from the bottom of the basin. The suction pressure of the slurry through the hollow diaphragm support is maintained at a constant value and is controlled (10–500 mbar below the atmospheric pressure of the surroundings).

The accretion step can be subdivided into time intervals between which the frequency and the suction pressure are increased stepwise.

The electrolysis process becomes more economical with the use of the diaphragm produced according to this invention.

9 Claims, No Drawings

PROCESS FOR THE PRODUCTION OF A DIAPHRAGM FOR ELECTROLYTIC CELLS

BACKGROUND OF THE INVENTION

1. Field of the Invention

This invention relates to a process for the production of a diaphragm for electrolytic cells used for the electrolysis of, for example, alkali metal halides in an aqueous solution.

An object of this invention is to provide a process that renders the formation of a stratified diaphragm more uniform, wherein the diaphragm is precipitated or deposited from a suspension having a high solids content of diaphragm material onto a hollow diaphragm support.

2. Review of Prior Art

Such diaphragms are manufactured according to the following exemplary method, which will be explained with reference to a diaphragm suitable for alkali chloride electrolysis; the diaphragm is in this case applied to a diaphragm support which is subsequently connected as the cathode in an electrolytic cell (cathode—supported diaphragm).

The diaphragm support is a hollow body exhibiting several plate-shaped grid surfaces (e.g. course wire grids) for the deposition of the diaphragm material. The area of the grid openings ranges from 0,04 $cm^2$ to 4 $cm^2$. The inner spaces or pockets of these plates are in communication with one another and form the hollow chamber of the cathode containing the catholyte in the electrolyte bath. The anolyte is located on the outside of the greatly segmented diaphragm surface in the electrolyte bath. The hollow body generally has two openings, a smaller one for the catholyte outlet and a larger one from which the hydrogen escapes if the finished, coated diaphragm support is used as a cathode in the electrolyte bath.

A blend of short and long asbestos fibers, for example chrysotile asbestos, which blend can optionally contain fibers of organic, synthetic polymers or other organic and inorganic additives, is made into a slurry in a sodium-chloride-containing, dilute sodium hydroxide solution corresponding to the composition of the cell liquor and containing a small quantity of surfactants, and is introduced into a basin of adequate size. The solids content of the slurry ranges from 0,1% to 2,5%.

A suction pump is connected via a suction hose to the catholyte outlet of the still uncovered diaphragm support, and the diaphragm support is suspended in the basin with the slurry of the diaphragm material, the diaphragm support being completely submerged in the slurry. The plate-shaped grid surfaces are disposed vertically. With the aid of the suction pump, the slurry is sucked through the grid surfaces of the diaphragm support and pumped into a collecting vessel. The diaphragm material is deposited on the grid surfaces and there builds up the stratified (layer-type) diaphragm, which diaphragm is densified by the liquid flow on the grid surface. The pumped-off slurry is used later on for preparation of the next bath or suspension.

The completely covered or coated diaphragm support is dried in an oven and—depending on the type of materials added to the slurry—treated at elevated temperature, whereby the diaphragm is inherently stabilized. This completes the coating process for the diaphragm support, and a ready-for-use diaphragm is provided. Details on the process are contained, for example, in DAS Nos. 2,401,942, 2,608,398, 2,756,720, 2,834,556; U.S. Pat. No. 4,180,449; European Pat. No. 1,664, and European Pat. No. 18,034.

The type and progression of accretion of diaphragm material on the diaphragm support are of decisive importance for the properties of the diaphragm during the subsequent electrolytic process in the electrolytic cell. As long as the diaphragm has an area of up to about 0.2 $m^2$, as utilized for electrolytic cells on a laboratory scale, it is easy to apply a uniform diaphragm layer. In contrast, industrial-scale cells exhibit a diaphragm area of up to 60 $m^2$. In such large diaphragms, differences are repeatedly encountered in structure and characteristic of the diaphragm, within one of these large-sized coatings as well as between several diaphragms manufactured in succession under unchanged conditions. Such differences cause adverse effects in the degree of current efficiency of the electrolytic cells, in their operating life, and in the composition of the electrolysis products.

The desired, unifrom diaphragms are characterized by a maximally constant layer thickness and a maximally constant packing density of the diaphragm material, as well as by a maximally constant flow resistance over the entire surface area.

These conditions are to be complied with within the diaphragm on a diaphragm support as well as between the diaphragms on several supports; this can be achieved only by means of a sufficiently uniform and reproducible accretion procedure and heretofore has not been satisfactorily realized in production of large-sized diaphragms.

Consequently, an object of this invention is to effectively improve the accretion process of the diaphragm material on the diaphragm support.

SUMMARY OF THE INVENTION

This object has been attained according to this invention by a process characterized by the following steps:

- the diaphragm support, during the deposition process of the diaphragm material, is raised and lowered in the slurry in the vertical direction, i.e., oscillated, with a predetermined frequency, amplitude, and velocity;
- the liquid level of the slurry in a deposition basin is continuously metered;
- the upper reversal point of the topside of the diaphragm support during the movement through the slurry lies at a predetermined distance below the level height of the slurry bath;
- the lower reversal point of the bottom side of the diaphragm support cannot reach below a minimum distance from the bottom of the deposition basin; and
- the suction pressure within the cavity of the diaphragm support is measured and maintained constant at a predetermined value.

DETAILED DESCRIPTION OF THE INVENTION

A crane is used for raising (i.e., lifting) and lowering of the diaphragm support; the diaphragm support is introduced into the basin with the crane; the diaphragm support is suspended during the entire accretion process on the crane; and the diaphragm support is withdrawn from the basin with the crane. The accretion tank is from 0.2 m to 1 m longer and wider than the diaphragm support.

While the slurry is sucked through the grid wire surfaces of the diaphragm support, the level of the slurry in the basin gradually decreases. The level height is measured continuously according to a conventional procedure, for example with a float gauge or by a gas bubble tube. The tube is mounted vertically inside the accretion tank near one side of its walls. The lower end of the tube is positioned somewhat above the bottom of the tank. Through the tube compressed air is flowing with a constant rate. The air pressure necessary to meet this requirement decreases with decreasing level height and is therefore a suitable measure for the level height. A measuring instrument detects the variable position of the upper reversal point of the oscillating motion of the support in a manner known per se, and transmits a signal indicative of this position to a control unit. The amplitude of the oscillating motion is set to a definite value being smaller than the maximum value possible. At the upper reversal point of the oscillating motion the top side of the diaphragm support is always in a definite distance below the liquid level of the bath. The upper reversal point moves downwards as soon as the level height decreases. The frequency and the amplitude of the oscillating motion as well as the lower limit position are set by the control unit.

The control unit, using conventional control apparatus determines the direction of rotation, the rotational speed, and the operating period of the crane motor.

The suction pressure of the pump is measured in the cavity of the diaphragm support by means of a conventional pressure gauge and regulated to be at a predetermined value by means of a control valve. A pressure gauge is preferably inserted in the hydrogen outlet orifice of the diaphragm support. The suction pressure ranges from 10 mbar to 500 mbar below ambient air pressure.

The frequency of the vertical oscillating motion ranges between 0.1 and 10 $min^{-1}$; and the amplitude ranges between 10 cm and 100 cm. At the upper reversal point of the oscillating motion, the topside of the diaphragm support is 10–25 cm below the liquid level of the bath. At the lower limit position, the underside of the diaphragm support is at least 30 cm above the bottom of the deposition basin or tank.

A plot of path versus time of the oscillating motion represents, for example, the curve of a sawtooth oscillation or of a trapezoidal relaxation oscillation, in each case with a declining position of the axis. The lifting and lowering speed of the diaphragm support is 2–20 cm/sec. During the time segments or portions of an oscillation phase not occupied by the lifting and lowering motion, the diaphragm is, in the upper or lower point of reversal of oscillation, in the stationary position. The time of rest ranges from 10 seconds to 60 seconds and can be distributed between the two reversal points in an extensively arbitrary fashion; a division of equal parts for both points of reversal is preferred.

The duration of the accretion step is dependent on parameters such as desired thickness of diaphragm on the diaphragm support and solids content of slurry, which are irrelevant to the process of this invention. This time period, however, can be split up into two or more segments wherein the characteristics essential to the process of this invention are changed within the acceptable ranges; it is also possible to alter these characteristics continuously during the deposition process.

In a division of the deposition process into two time segments, the bottom layer of the diaphragm is built up on the grid surfaces in the first time segment; the flow resistance of the grid surfaces is still minor, and the resultant diaphragm is sensitive to the forces of flow. The suction pressure and the oscillation frequency are consequently low. In the second segment, the diaphragm has become thicker, the flow resistance has risen, and the diaphragm is less sensitive to the forces of flow. Therefore, suction pressure and oscillation frequency are raised.

The separating line between these two segments has been reached as soon as a predetermined amount of slurry has been pumped into the collecting vessel. This amount is determined by experience. Normally the first time segment is half as long as the second time segment.

The suction pressure of the pump at which the slurry is sucked through the grid surfaces of the diaphragm support is adjusted to a predetermined value. During the first segment of the accretion process, the suction pressure ranges between 10 and 100 mbar below the atmospheric pressure in the surroundings, if a slurry of asbestos fibers is employed, heretofore suitable for diaphragms in alkali chloride electrolysis. The oscillating frequency ranges between 0.1 and 2 $min^{-1}$.

In the second time segment, the suction pressure is increased from that employed in the first segment and usually is from about 100–500 mbar ambient air pressure. The oscillating frequency in this segment ranges is also greater and is between 2 and 10 $min^{-1}$.

It proved to be advantageous to perform the process of this invention in a maximally automatic fashion by means of conventional auxiliary devices of measuring, control, and operating technology, so that the process is relieved as much as possible from uncontrollable influences.

The advantages of the process of this invention are as follows:

The position of the diaphragm support during the depositing step is reproducible within the basin and is based on the varying level of the slurry.

The hydrostatic pressure in the depositing basin, affecting the depositing process especially in the initial stage in spite of a constantly maintained suction pressure, can be reproduced for all depositing procedures.

No diaphragm support can be lifted by mistake too closely toward the height of the slurry level, or partially out of the slurry.

No diaphragm support can knock against the basin bottom by mistake.

By eliminating disturbing influences present heretofore, the suction pressure fluctuations become rather small.

Amplitude and frequency of the vertical oscillating motion of the diaphragm support are exactly observed.

Depending on the extent of automation of the process, the demand of manpower can be reduced.

These advantages have the following effects on the structure of the diaphragm:

The diaphragm material is deposited in a substantially more uniform fashion on the grid surfaces; layer thickness and packing density vary to a markedly lesser extent than heretofore within the diaphragm on one diaphragm support and between the diaphragms on several supports.

Asbestos bridges no longer occur between the parts of the grid surface; during the heretofore necessary manual stripping of these bridges, the still fresh diaphragm was frequently damaged.

The crucial improvements in alkali chloride electrolysis with the use of the diaphragms produced according to the process of this invention are:

The chlorine yield in the cell gas rises, and the content of undesired oxygen in the chloride gas drops.

The concentration of undesired sodium hypochlorite in the cell liquor becomes lower.

The electric current efficiency of the electrolytic cell rises.

The useful life of the diaphragms increases.

The reproducible depositing procedure permits correlation of parameter changes of this process with the behavior of the diaphragm during electrolysis. The influence of the solids content of the slurry on the cell voltage (at fixed current density) can be readily perceived. The cell voltage can be reduced in a controlled fashion and can be kept at a low value over a relatively long period of time.

EXAMPLE

The process of this invention proceeds, for example, as follows:

An asbestos slurry is prepared in approximately 20 $m^3$ of cell liquor, containing 15% NaOH and 15% NaCl as indicated in DAS No. 2,401,942. The cell liquor is the fluid which leaves the electrolysis cells and needs no special make up.

The hollow diaphragm support with grid surfaces is connected to the suction pump at the catholyte outlet. The pressure gauge is inserted in the hydrogen outlet. The diaphragm support with a diaphragm surface area of about 60 $m^2$ is immersed in the slurry by means of a crane.

The suction pressure of the pump is set and controlled at 45 mbar below ambient air pressure. The vertical oscillating motion of the diaphragm support has a frequency of 1 $min^{-1}$ and an amplitude of 30 cm. The speed of the lifting and lowering motion is 6 cm/sec. In the upper reversal point, the topside of the diaphragm support lies 20 cm below the gradually dropping level of the slurry. The diaphragm support stays for respectively about 25 seconds in the upper and lower reversal points. Under these conditions, about 2.5 $m^3$ of the slurry is sucked through the grid surfaces and pumped into the collecting vessel; during this process, the level drops by about 30 cm. This stage of procedure takes about 15 minutes.

Thereafter the suction pressure is raised to 350 mbar below ambient air pressure; the oscillating frequency is raised to 3 $min^{-1}$. The amplitude as well as the lifting and lowering speed remain unchanged. The diaphragm support remains for respectively about 5 seconds in the upper and lower reversal points.

During the following 30 minutes, another 7.5 $m^3$ of slurry, approximately, is sucked through the grid surfaces and pumped into the collecting vessel, the level dropping by another 90 cm, approximately. This completes the accretion step of this invention.

The newly coated diaphragm support is lifted out of the basin. Outside the basin, the suction pressure in the cavity of the diaphragm support is maintained for another 3 hours and the diaphragm is predried. Subsequently, the coated diaphragm support is dried in an oven at about 95° C. and, depending on the composition of the slurry, exposed to an elevated temperature.

Comparison of the Diaphragms Produced According To the Invention with Heretofore Conventional Diaphragms Diaphragms produced according to the process of this invention were inserted in a group of 35 cells of an alkali chloride electrolysis plant with a diaphragm area of about 50 $m^2$ per cell. For comparison purposes, another group of 34 cells of this plant was equipped with diaphragms manufactured by the heretofore customary method, i.e., with an uncontrolled vertical movement of the diaphragm support and with a greatly fluctuating suction pressure during the accretion step. The composition of the slurry of diaphragm material was left unchanged for all cells except for the solids content which was varied from 11 g/l to 17 g/l.

The results presented in Table 1 and Table 2 were obtained in the preparation and operation of these two cell groups. Within each of the two cell groups, the cells were combined into respectively three subgroups in dependence on the solids content of the slurry, to provide better comparability.

The current efficiency and the specific power consumption were determined from the quantity of chlorine gas produced by the cells and from the electrical energy supplied to the cells. In both cell groups, the load fluctuated within the range customary for such large-scale installations.

As demonstrated by comparing the two cell groups with regard to current efficiency and cell voltage, it is possible by means of diaphragms produced according to the process of this invention, at a solids content of the slurry of less than 12 g/l, to attain a current efficiency of 96% at a cell voltage as low as 3.32 V; whereas a value of merely 94% is attained with diaphragms manufactured by the conventional method at approximately the same cell voltage. This improvement may seem small, but it is of crucial importance for the economy of the alkali chloride electrolysis, especially since this improvement was achieved with comparatively small expense.

There is no relationship between specific energy consumption and solids content of the slurry in diaphragms produced by the customary process. In contrast hereto, this dependency can be clearly observed in diaphragms produced by the method of this invention; below 12 g/l of solids content, the specific power consumption is 2,610 kWh per ton of chlorine; whereas the specific power consumption is 2,660 kWh per ton of chlorine at a value above 13 g/l of solids content. This difference is likewise considerable for large-scale industrial plants.

With the oxygen concentration in the chlorine gas and the chlorate concentration in the cell liquor, the mean value as well as the range are markedly smaller for the diaphragms manufactured according to this invention than for the conventional diaphragms.

None of the diaphragms produced according to the invention were replaced for the duration of the experiment; whereas, in total, four of the diaphragms manufactured by the conventional method were replaced on account of gradually deteriorating properties of the diaphragm.

TABLE 1

| Comparison of Diaphragms; Diaphragm Data | Diaphragm Produced by | | |
|---|---|---|---|
| Number of Cells In Cell Group | Process of Invention 35 | Conventional Process 34 | Cells |
| Diaphragm Mass Mean Value | 110.2 | 113.0 | kg per Cell |
| Standard Deviation | 3.8 | 5.8 | kg |
| Range | 104–122 | 103–125 | kg |

TABLE 2

Comparison of Diaphragams; Operating Data after Differently Long Operating Periods of the Cells ( $\bar{x}$ Mean Value; R Range)

| | | Diaphragm Manufactured by | | | | | | |
|---|---|---|---|---|---|---|---|---|
| | Days of | Process of Invention | | | Conventional Process | | | |
| Solids Content of Slurry | Operation | <12 | 12–13 | >13 | <12 | 12–13 | >13 | g/l |
| Current Efficiency | 12 | 95.6 | 96.1 | 96.3 | 93.0 | 93.0 | 92.7 | % |
| | 35 | 96.0 | 95.9 | 96.0 | 94.2 | 93.8 | 93.8 | |
| | 56 | 96.1 | 96.1 | 95.8 | 94.7 | 94.4 | 94.5 | |
| | 75 | 95.9 | 96.0 | 96.4 | 94.3 | 94.3 | 94.5 | |
| Cell Voltage at 2 kA/m$^2$ | 12 | 3.31 | 3.35 | 3.40 | 3.31 | 3.32 | 3.37 | V |
| | 35 | 3.32 | 3.36 | 3.39 | 3.30 | 3.33 | 3.35 | |
| | 56 | 3.32 | 3.37 | 3.39 | 3.31 | 3.34 | 3.34 | |
| | 75 | 3.32 | 3.38 | 3.40 | 3.32 | 3.34 | 3.34 | |
| Specific Power Consumption at 2 kA/m$^2$ | 12 | 2610 | 2630 | 2670 | 2690 | 2700 | 2750 | kWh per t Chlorine |
| | 35 | 2620 | 2640 | 2660 | 2650 | 2680 | 2700 | |
| | 56 | 2610 | 2640 | 2670 | 2650 | 2680 | 2680 | |
| | 75 | 2610 | 2650 | 2660 | 2670 | 2680 | 2670 | |
| Oxygen Concentration $\bar{x}$ in Chlorine Gas R | | | 1.7 | | | 2.6 | | vol % |
| | | | 1.2–2.0 | | | 1.7–3.7 | | |
| Na Chlorate $\bar{x}$ Concentration in R Cell Liquor | | | 0.17 | | | 0.25 | | g/l |
| | | | 0.1–0.3 | | | 0.2–0.7 | | |
| Replaced Diaphragms | 60 | | None | | | None | | |
| | 90 | | None | | | 3 | | |
| | 120 | | None | | | 4 | | |

We claim:

1. In a process for the production of a diaphragm for electrolytic cells wherein the diaphragm is accreted on vertically disposed grid surfaces of a hollow diaphragm support from a slurry having a high solids content of diaphragm material, and the diaphragm is subsequently dried, and optionally aftertreated at an elevated temperature, the improvement which comprises
   - periodic lifting and lowering the diaphragm support to provide an oscillating vertical motion with predetermined frequency, amplitude, and velocity within the slurry during accretion of the diaphragm material from an accretion tank;
   - continuous measuring the level height of the slurry within said tank;
   - maintaining a predetermined spacing of a topside of the diaphragm support in an upper reversal point of the oscillating motion from the instantaneous level of the slurry within the tank;
   - maintaining a minimum distance of an underside of the diaphragm support from the bottom of the accretion tank; and
   - maintaining a predetermined suction pressure within a hollow space of the diaphragm support whereby a diaphragm with a diaphragm area up to 60 m$^2$ having a uniform thickness and uniform packing density is produced.

2. A process according to claim 1, wherein the frequency of the vertical oscillating motion of the diaphragm support is maintained between 0.1 and 10 min$^{-1}$.

3. A process according to claim 1 or 2, wherein the amplitude of the vertical oscillating motion of the diaphragm support is maintained between 10 cm and 100 cm.

4. A process according to claim 3, wherein the velocity of the diaphragm support during lifting and lowering portion of the oscillating motion is from 2 to 20 cm/sec.

5. A process according to claim 1, wherein a spacing of 10 to 25 cm of the topside of the diaphragm support in the upper reversal point is maintained from the instantaneous level of the slurry.

6. A process according to claim 1, wherein by a spacing of at least 30 cm of the underside of the diaphragm support is maintained from the bottom of the accretion tank.

7. A process according to claim 1, wherein the suction pressure in the hollow space of the diaphragm support is maintained between 10 and 500 mbar below ambient air pressure.

8. A process according to claim 1, wherein the accretion step is subdivided into several time segments, the suction pressure and the oscillating frequency is stepwise increased between the time segments.

9. A process according to claim 8, wherein the accretion step is subdivided into two time segments, the first time segment comprising approximately the first quarter of the entire accretion step, an oscillating frequency of 0.1–2 min$^{-1}$ being maintained in the first time segment at a suction pressure of between 10 and 100 mbar, and an oscillating frequency of 2–10 min$^{-1}$ being maintained in the second time segment at a suction pressure of between 100 and 500 mbar.

* * * * *